United States Patent [19]

Cavoretto

[11] 4,206,313

[45] Jun. 3, 1980

[54] PIPE CLEANING NOZZLE

[75] Inventor: John J. Cavoretto, Richmond, Calif.

[73] Assignee: S. D. Meo, Oakland, Calif.

[21] Appl. No.: 910,576

[22] Filed: May 30, 1978

[51] Int. Cl.[2] ..... B08B 3/02; B08B 9/04

[52] U.S. Cl. ..... 134/167 C; 134/24; 239/DIG. 13

[58] Field of Search ..... 134/22 C, 24, 166 C, 134/167 C, 168 C, 169 C, 179; 239/DIG. 13

[56] References Cited

U.S. PATENT DOCUMENTS

| | | | |
|---|---|---|---|
| 1,448,876 | 3/1923 | Sladden | 134/167 C |
| 1,587,194 | 6/1926 | Sladden | 134/167 C |
| 2,336,293 | 12/1943 | Pletcher | 134/22 C X |
| 3,678,948 | 7/1972 | Hedges | 134/167 C |
| 3,744,723 | 7/1973 | Davis | 134/167 C X |
| 3,814,330 | 6/1974 | Masters | 134/167 C X |

FOREIGN PATENT DOCUMENTS

| | | | |
|---|---|---|---|
| 371983 | 5/1973 | U.S.S.R. | 134/167 C |

*Primary Examiner*—Robert L. Bleutge
*Attorney, Agent, or Firm*—Warren, Chickering & Grunewald

[57] ABSTRACT

A nozzle useful for cleaning deposits from the interior wall of a pipe, the nozzle including a body having a hose connection for accepting a stream of high pressure fluid and having at least three skids to hold the body away from the interior pipe surface, and a turbine connected to the body through a bearing, the body including jets to discharge high pressure fluid in a direction to propel the nozzle through the pipe being cleaned and the turbine having jets positioned to drive the turbine to rotate and to impinge against the interior wall of the pipe.

4 Claims, 2 Drawing Figures

PIPE CLEANING NOZZLE

BACKGROUND OF THE INVENTION

Some pipe systems carry fluid that causes deposits to form on the interior walls of the pipes. A typical pipe system of this type is a sewer system. Although the invention described and claimed herein is suitable for any such pipe system, it will be described as used in a sewer system for convenience.

Sewer systems carry wastes of varying composition from homes and from industry. Some wastes are solid in finely subdivided form, some are aqueous solutions, some are oily, waxy or greasy, some are insoluable in water, some are viscous, some change their physical properties with temperature changes or when exposed to air or when exposed to other materials in the sewer system such as acids, bases, soaps, to name a few.

In addition to the varying materials that are carried, sewer pipes sometimes run almost full and sometimes run almost empty, but most of the time run with a liquid level that is intermediate between full and empty. As a result of the varying flow conditions and compositions that are found in sewer systems, deposits that are mostly of oily material build up on the interior walls of sewer pipes and restrict the cross section of the pipes available for the flow of fluid. Eventually, flow becomes so restricted that the sewer pipes must be cleaned to restore their ability to carry the normal volume of fluid for which they were designed. The cleaning generally amounts to removing the oily deposits from the interior walls of the sewer pipes.

Sewer systems are largely gravity flow systems where flow is caused by placing the pipe at a gentle angle with horizontal. Cleaning of sewers is frequently accomplished hydraulically by passing a nozzle through the sewer which directs one or more high pressure jets of water against the interior sewer pipe walls. The nozzles are generally fed with a hose that is in turn connected to a source of high pressure fluid, and the problem of driving the nozzle through the pipe has been solved in the past by using at least some of the high pressure fluid as a jet to drive the nozzle. Nozzles of this type are disclosed in U.S. Pat. No. 3,744,723 issued to Davis, U.S. Pat. No. 3,678,948 issued to Hedges, and U.S. Pat. No. 3,814,330 issued to Masters. In these patents, the nozzle is propelled through the pipe to be cleaned by jets of water while the same jets or different jets are employed to clean the interior wall of the pipe by discharging one or more high pressure fluid streams against the interior wall of the pipe.

As stated above, the deposits on sewer pipe walls generally are oily material. If the oily material forming the deposit is soft enough, it is not uncommon for the cleaning jets to simply dig trenches in the oily material rather than dislodging it. To overcome this problem, jets have been oriented in a cleaning nozzle to discharge in a nonradial direction, thereby producing a swirling flow for the cleaning fluid. Although discharging cleaning fluid nonradially is some improvement, it has been found that the reaction to the nonradial jet is to twist the feed hose, and in most cases the nonradial jet still only causes the cleaning stream to dig trenches in the oily material coating the interior pipe wall.

As used in this specification and the appended claims, the term pipe is employed in its generic sense to include tubing or any other form of conduit. The term hose is also employed in its generic sense to include any equivalent elongated, flexible fluid-carrying means that is capable of supplying high pressure fluid to a nozzle.

SUMMARY OF THE INVENTION

This invention overcomes or greatly diminishes the problems associated with known nozzles for cleaning interior pipe walls. This invention is a nozzle for cleaning the interior surface of a pipe which includes a body and a rotating turbine surrounding at least a portion of the body. The body preferably has skids to hold the entire device above the bottom surface of the pipe and is further provided with a hose connection and a number of driving jets discharging back toward the hose. The turbine employed in the device of this invention is connected to the body with a suitable bearing and it has a number of cleaning jets positioned both to impinge against the wall of the pipe and to drive the turbine to rotate. The turbine desirably is driven at relatively high speed so that as the nozzle passes slowly through a pipe to be cleaned, each portion of the pipe wall will be scoured a number of times by the various jets of water discharging from the turbine.

A preferred manner for using the device of this invention is to connect the nozzle to a long hose that is capable of carrying water at high pressure, for example 1,000 lbs. per square inch. The nozzle is then introduced into the sewer line to be cleaned at a downstream position and when water is supplied to the nozzle at high pressure, the driving jets quickly carry the nozzle upstream in the sewer pipe and drag the hose supplying the nozzle behind it. At 1,000 lbs. per square inch pressure, the drive jets can propel the nozzle upstream through a sewer pipe very rapidly. While driving the nozzle upstream, very little cleaning of the interior pipe walls is effected.

When the nozzle has been driven upstream far enough, usually as far as the next entry point into the sewer system, the hose supplying the nozzle with fluid is slowly retrieved. The force of the drive jets holding the nozzle upstream against the force of retrieving the hose downstream provides a great deal of control over how rapidly the nozzle is moved in its cleaning function. Cleaning is effected by slowly pulling the hose back against the driving force of the jets and while the hose is slowly retrieved, the cleaning jetson the turbine repeatedly scour every portion of the interior surface of the pipe. The cleaning jets preferably impinge against the pipe walls at a slight angle to perpendicular and in a direction from perpendicular so that material dislodged from the pipe wall will be urged downstream in the sewer system. The material scoured from the pipe wall is carried downstream initially by the force of the jet dislodging it and then by the flow of liquid through both the cleaning jets and the driving jets that cause a continuous downstream flow of cleaning fluid. Normally, the cleaning fluid is water although it could be any liquid or gas that is suitable for dislodging and carrying away the particular material coating the interior of the pipe to be cleaned.

It has been found that the nozzle of this invention completely scours the interior surface of a pipe wall rather than to dig trenches in the accumulated greasy deposits. The deposits are removed in the form of thin flakes and the fundamental direction of the scouring jets is circumferential rather than axial within the pipe. In effect, the scouring jets describe a multiple helical path within the material encrusted on the interior pipe wall with the distance between adjacent loops of the helixes being just a fraction of an inch. The turbine-mounted cleaning jets do such an effective job of dislodging deposits from the interior of sewer walls that the nozzle can be drawn through the sewer pipe in its cleaning cycle quite rapidly while still doing an effective job of removing deposits. It has been found in fact that the turbine-mounted cleaning jets are so effective that substantially less water is needed to clean a length of pipe than is needed in previously known cleaning nozzles, which not only represents a saving in water but additionally a saving in the capacity of a system and the energy required to run it for providing large amounts of water at high pressure. It has also been found that the free running turbine does not produce a reaction force on the hose supplying high pressure fluid to the nozzle of this invention and that hoses employed with the nozzles of this invention last far longer than hoses subjected to twisting by reaction to the jets in a nozzle.

DETAILED DESCRIPTION OF THE INVENTION

This invention may be better understood with reference to the accompanying drawings.

Figure 1:
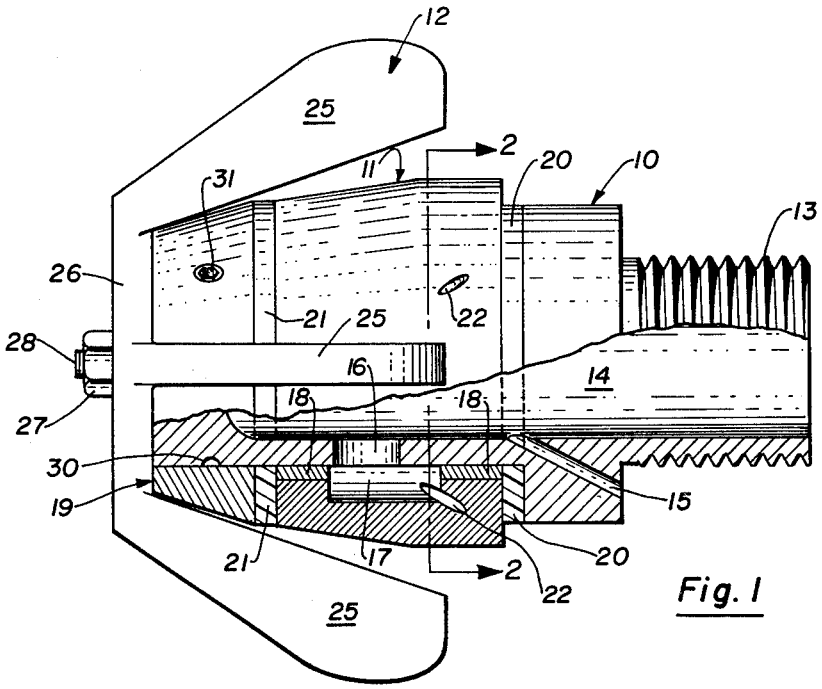
FIG. 1 is a side view of a nozzle embodying this invention shown partly in section.

The device illustrated in the drawings consists essentially of four major portions. The portion generally designated 10 is the body of the device, the portion generally designated 11 is the turbine portion of the device, the portion generally designated 12 is skids to hold the device away from the walls of a pipe being cleaned, and the portion generally designated 19 is a bushing to hold the turbine on the body. The body portion of the device includes a threaded hose connection 13 and a passageway 14 that leads to the interior of the body portion. A number of drive jets 15 (only one illustrated) discharge from the back end of the body 10, toward the hose connection 13, to provide a flow component in an axial direction which drives the device through a sewer pipe in a direction opposite to the direction that fluid is discharged through jets 15.

The passageway 14 also extends into the portion of the body 10 that is surrounded with the turbine 11. The body 10 includes at least one port 16 which supplies water to the chamber 17 in the turbine 11.

Figure 2:
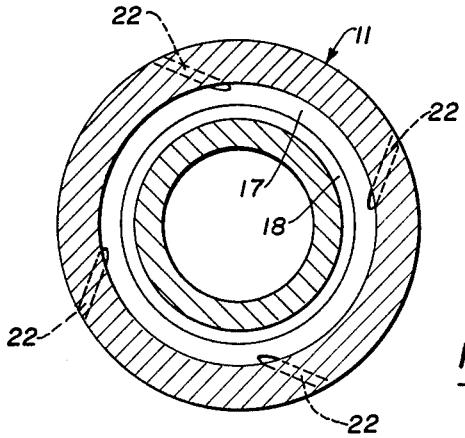
FIG. 2 is a sectional view of the device illustrated in FIG. 1 shown in cross section taken along the line 2—2.

Turbine 11 surrounds the body 10 and is maintained in sliding relationship with it through bearings 18. The turbine is also spaced from the body 10 with suitable low friction washers 20 and 21 which are made of materials such as nylon. Thus, the turbine 11 is maintained in a surrounding relationship with the body 10 such that it is free to rotate around the axis that is common to the body 10, and the turbine 11 is provided with a number of cleaning jets 22. The cleaning jets 22, as illustrated in FIG. 1, discharge at an obtuse angle to the axis in order to provide a stream of cleaning fluid at an angle that diverges from the axis of the nozzle. These streams are directed to impinge against the walls of a surrounding pipe at an angle adapted to dislodge material deposited on those pipe walls. As best seen in FIG. 2, the cleaning jets 22 do not discharge radially from the turbine, but rather on a chord of the circular cross section of the turbine 11. By this orientation of the jets 22, the high pressure streams of cleaning fluid discharging through them not only dislodge material deposited on the walls of the pipe but also drive the turbine to rotate in a clockwise direction as illustrated in FIG. 2, In use employing water at 1,000 lbs. per square inch as the cleaning fluid, the turbine will rotate very rapidly when powered with nothing but the water passing through the jets 22.

The bushing 19 is made to hold the turbine 11 firmly on the body 10. The forward extension of the body 10 includes a trench 30 into which the end of a set screw 31 can enter. Assembly of the device can then easily be accomplished by first sliding washer 20 over the body 10, then sliding turbine 11 over the body 10, then installing washer 21, and finally sliding bushing 19 into place and fixing it there with a group of set screws 31.

The skid device 12 includes, as here illustrated, four wings 25 which are symmetric about a front portion 26. The wings are held to the front of the nozzle by a nut 27 that is placed on a threaded shank 28 that is fixed by welding or by a threaded hole to the front portion of the bushing 19. The wings 25 may be of any suitable size and shape but they should not extend back so far that fluid discharging through cleaning jets 22 will impinge against the wings 25.

What is claimed is:

1. A nozzle useful for removing deposits from the interior surfaces of a pipe comprising A. a body symmetric about a long axis, said body having
  i. a first passageway for the flow of fluid,
  ii. an inlet to said passageway having means to connect said inlet to a hose,
  iii. drive jets connecting to said first passageway and discharging from said body in a direction having sufficient axial component to propel said nozzle axially,
  iv. a second passageway discharging through said body wall perpendicular to said axis, B. a turbine surrounding said body and having
  i. cleaning jets positioned to discharge fluid in a direction to diverge from said axis in the direction of discharge of said drive jets and nonradially whereby the discharge of fluid through said cleaning jets creates force tending to rotate said turbine and causes fluid to impinge against the interior wall of said pipe,
  ii. a chamber surrounding said body to provide open communication between said second passageway and said cleaning jets, and C. bearing means between said body and said turbine to permit said turbine to rotate freely with relation to said body.

2. The device of claim 1 including at least three skids symmetrically placed around said axis, positioned to at least partly surround said turbine and positioned out of alignment with said cleaning jets.

3. The device of claim 1 including a bushing connectable to said body to hold said turbine between a shoulder on said body and said bushing.

4. The device of claim 3 including low friction elements between said turbine and the shoulder on said body and between said turbine and said bushing.

* * * * *